United States Patent [19]

Heilman

[11] Patent Number: 4,491,322

[45] Date of Patent: Jan. 1, 1985

[54] TENSIONING APPARATUS FOR A RACKET-STRINGING MACHINE

[76] Inventor: Karl J. Heilman, P.O. Box 2906, St. Louis, Mo. 63132

[21] Appl. No.: 512,584

[22] Filed: Jul. 11, 1983

[51] Int. Cl.[3] ..... A63B 51/14

[52] U.S. Cl. ..... 273/73 A; 254/254

[58] Field of Search ..... 273/73 A, 73 B; 254/254, 259, 384

[56] References Cited

U.S. PATENT DOCUMENTS

| | | | |
|---|---|---|---|
| 253,772 | 12/1979 | Chartier et al. | D15/199 |
| 2,069,736 | 2/1937 | Roberts | 273/73 A |
| 2,268,276 | 12/1941 | Caro et al. | 273/73 A |
| 3,988,022 | 8/1976 | Halbrook | 273/73 A |
| 4,125,259 | 11/1978 | Halbrook | 273/73 A |

*Primary Examiner*—Richard C. Pinkham

*Assistant Examiner*—Matthew L. Schneider

*Attorney, Agent, or Firm*—Senniger, Powers, Leavitt and Roedel

[57] ABSTRACT

A racket-stringing machine equipped with tensioning apparatus featuring a one-way clutch which eliminates the need to pull tension more than once per reach of string on the racket. The tensioning apparatus consists of a pair of grippers which grip and hold the strings. The apparatus further has a cylindrical member with a lever to which are attached weights. The clutch and the cylindrical member are attached by way of a coiled spring. The coiled spring is wrapped around a hub on the clutch and attached, at its end, to the cylindrical member. This construction allows the clutch and cylindrical member to rotate together in one direction while at the same time allowing only the clutch to rotate in the opposite direction.

14 Claims, 10 Drawing Figures

TENSIONING APPARATUS FOR A RACKET-STRINGING MACHINE

BACKGROUND OF THE INVENTION

The present invention relates generally to a machine for stringing rackets, such as tennis rackets and the like, and more particularly to apparatus useful on such a machine for pulling string to the desired tension.

Various devices have been developed over the years for stringing a racket at a selected tension. However, even with the aid of such devices, the stringing process has proven to be very time consuming. In many cases this is due to the less than efficient manner in which the string is tensioned.

One type of stringing device often used comprises a base, a vise on the base for holding the head of a racket in a fixed position lying in a generally horizontal plane, and tensioning apparatus on the base adjacent the vise for tensioning the string. This apparatus includes a cylindric drum mounted on the base for rotational movement about a generally horizontal axis, grippers on the drum for gripping a string on the racket, and a lever attached to the drum carrying a tensioning weight positioned on the lever according to the tension at which the racket is to be strung. To tension the string, the grippers are operated to grip the string and the lever is allowed to swing down under its own weight and that of the tensioning weight to rotate the drum and grippers thereon for tensioning the string. To ensure that the desired tension is attained, the lever must come to rest at a substantially horizontal position. If it drops below horizontal, indicating that the desired tension has not been reached, the string must be clamped at the racket to hold the tension, the lever raised, and the process repeated, which involves regripping the string and then guessing where to position the lever to start the second "pull" so that when the lever is dropped it stops at a horizontal position. This process is not only extremely time consuming, it may also result in damage to the string due to the repetitive clamping and unclamping of the string at the racket.

Reference may be made to U.S. Pat. Nos. 4,125,259, 3,988,022 and U.S. Pat. No. Des. 253,772 for a description of racket-stringing machines generally in the field of this invention.

SUMMARY OF THE INVENTION

Among the several objects of this invention may be noted the provision of an improved racket stringing machine which is easy to operate and which reduces stringing time; the provision of such a machine which requires only one "pull" (i.e., tensioning without reclamping at the racket) per reach of string to arrive at the desired tension, thereby minimizing clamping and unclamping of the string to avoid string damage; the provision of such a machine which provides a high level of tension accuracy; and the provision of such a machine which is durable and which is capable of handling a variety of different racket frame sizes and styles.

Generally, a racket-stringing machine of the present invention comprises a base, means on the base for holding the head of a racket in a generally horizontal plane and in fixed position with respect to the base, and tensioning apparatus adjacent said holding means for pulling a string on the racket to a predetermined tension. The tensioning apparatus is characterized in that it comprises a generally cylindric member mounted on the base adjacent said holding means for rotation on a generally horizontal axis lying in a vertical plane extending generally perpendicular to the direction in which the string is to be tensioned, means on the cylindric member for gripping the string, and means for rotating the cylindric member on said axis when said gripping means is gripping the string thereby to pull the string to the aforesaid predetermined tension. The rotating means comprises a one-way clutch adapted for rotating the cylindric member on said axis in one direction but not the opposite direction, a lever on the clutch extending generally radially with respect to said axis, and a tensioning weight positionable on the lever for causing the lever to swing downwardly to rotate the clutch and the cylindric member in said one direction to a position in which the lever is either generally horizontal, indicating that the string is at said predetermined tension, or below horizontal, indicating that the string is at less than said predetermined tension, whereupon the lever is adapted to be swung upwardly to rotate the clutch in said opposite direction, with the cylindric member being held stationary as the clutch is so rotated, to a position sufficiently above horizontal that when the lever is released the tensioning weight will cause the lever to swing downwardly to rotate the clutch and the cylindric member in said one direction to a position in which the lever is generally horizontal indicating that the string is at said predetermined tension.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF A PREFERRED EMBODIMENT

Figure 1:
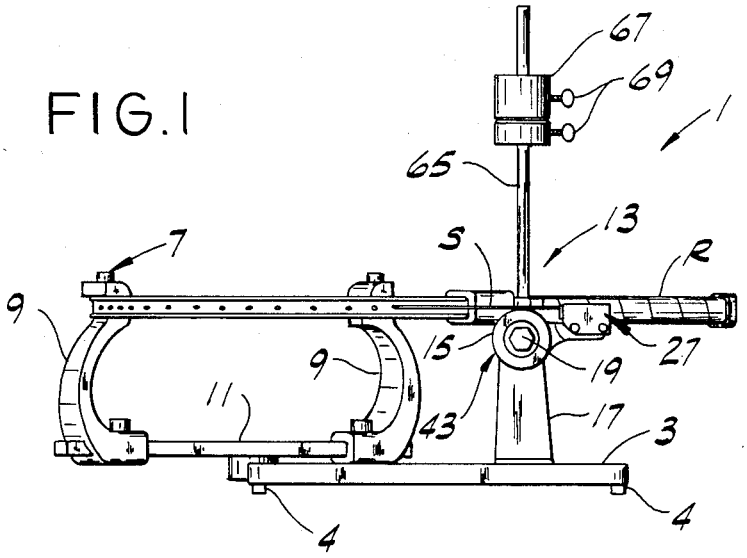
FIG. 1 is an elevation of a racket stringing machine incorporating tensioning apparatus of the present invention.

Referring now to the drawings, there is generally indicated at 1 a machine of the present invention for stringing rackets used in playing tennis, badminton, racquetball and squash, for example, one such racket being designated R in FIG. 1. The machine comprises a rimmed rectangular base 3 on legs 4 and a vise, generally designated 7, on the base for holding the head of racket R in a generally horizontal plane and in fixed position with respect to the base. The vise 7 is of conventional design, comprising a pair of vise end stocks, each designated 9, slidably adjustable on a swivel bar 11 which is mounted on the base for pivoting on a vertical axis.

In accordance with this invention, the stringing machine also includes improved tensioning apparatus, generally indicated at 13, for applying tension to each reach of string S on the racket. This apparatus 13 comprises a generally cylindric member or drum 15 mounted at the upper end of a post 17 affixed to the base, the drum being rotatable on a generally horizontal axis AX1 lying in a vertical plane extending generally perpendicular to the direction in which a reach of string S on the racket is to be tensioned (see FIG. 2). As shown in FIG. 3, the drum is rotatable on a bolt 19 extending horizontally through the upper end of post 17. The outside (left as viewed in FIG. 3) face of the drum 15 is countersunk as indicated at 21 to receive the head of the bolt and a suitable bearing 23 which ensures free and easy rotation of the drum on the shank of the bolt. The drum has an integral arm 25 extending laterally outwardly therefrom (i.e., generally radially with respect to axis AX1).

Figure 2:
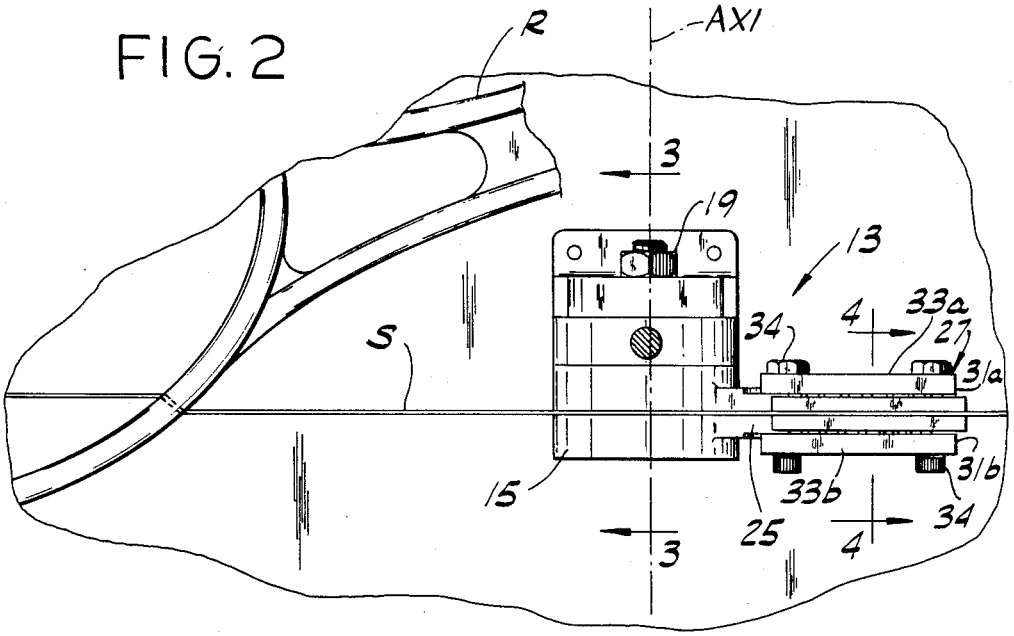
FIG. 2 is a plan of FIG. 1.
Figure 4:
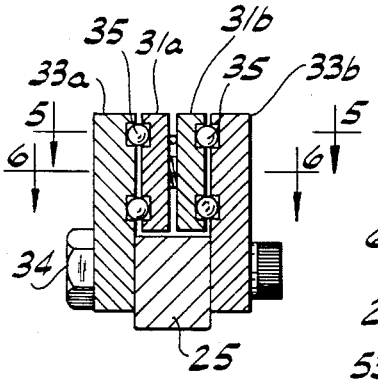
FIG. 4 is an enlarged vertical section on line 4—4 of FIG. 2 illustrating grippers of the tensioning apparatus in a closed position.
Figure 3:
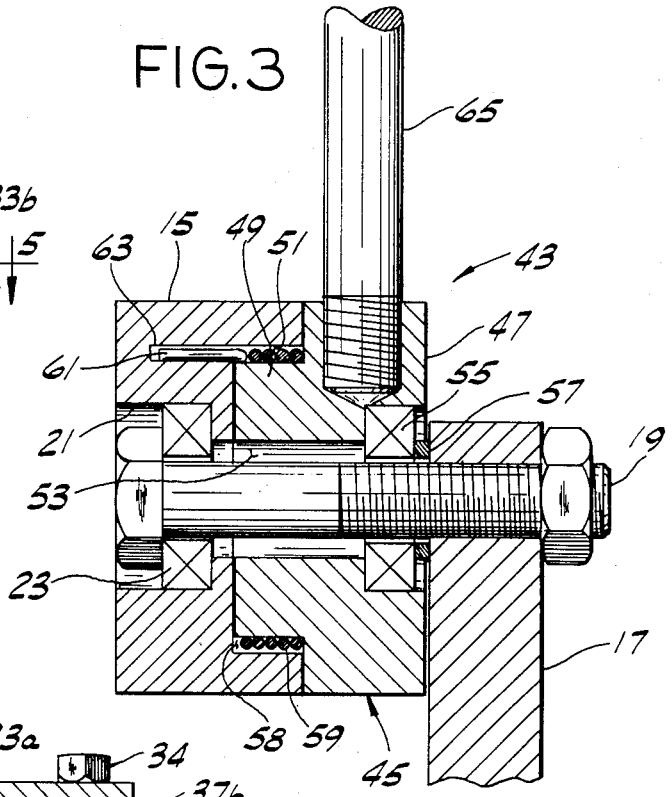
FIG. 3 is an enlarged vertical section on line 3—3 of FIG. 2.

Mounted on this arm 25 is means generally designated 27 for gripping a reach of string S to be tensioned and for holding it in a position in which the string lies in a vertical plane which is generally perpendicular to the vertical plane containing axis AX1 (see FIG. 2). Means 27 comprises a pair of grippers designated 31*a*, 31*b* mounted on the arm 25 of drum 15 for linear movement with respect to the arm from an open position (FIG. 5) in which the grippers are spaced apart a distance greater than the diameter of string S to enable the string to be inserted between the grippers, to a closed position (FIG. 4) in which the grippers are spaced closer together for gripping the string therebetween, and then back to the stated open position for releasing the string. In the embodiment shown in the drawings, the grippers 31*a*, 31*b* are constituted by two rectangular generally parallel metal plates mounted between a second pair of generally parallel spaced apart mounting plates 33*a*, 33*b* secured by suitable fasteners 34 to arm 25 on opposite sides of the arm, the gripper plates 31*a*, 31*b* being disposed in face-to-face relation with the mounting plates 33*a*, 33*b*.

The gripper plates 31*a*, 31*b* are mounted for linear movement between the mounting plates 33*a*, 33*b* in a direction generally parallel to arm 25 by a plurality of sets of ball bearings 35 (four such sets being shown in the drawings). The ball bearings 35 of each set are received in a pair of cooperating grooves 37*a*, 37*b* in the opposing faces of a mounting plate and a respective adjacent gripper plate. These two cooperating grooves 37*a*, 37*b* form a linear raceway for the ball bearings extending longitudinally of the mounting and gripper plates generally parallel to the arm 29. The arrangement is such that the gripper plates 31*a*, 31*b* are adapted to glide on the sets of ball bearings between their open and closed positions, the gripper plates being movable inwardly with respect to the arm (i.e., toward drum 15) to their closed position and outwardly with respect to the arm (i.e., away from drum 15) to their open position.

Figure 5:
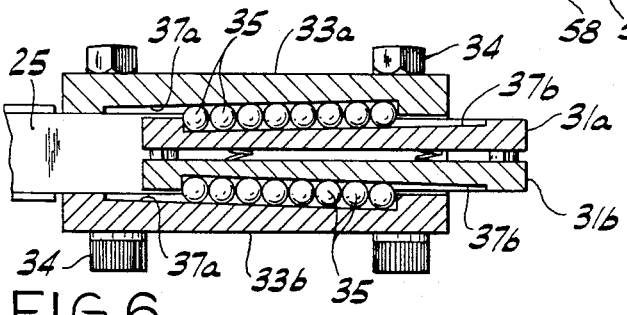
FIG. 5 is a horizontal section on line 5—5 of FIG. 4 showing the grippers in an open position.
Figure 6:
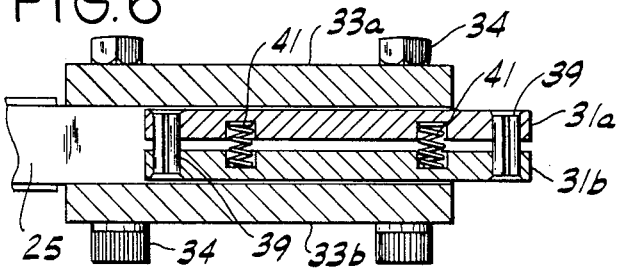
FIG. 6 is a horizontal section on line 6—6 of FIG. 4.

As best illustrated in FIG. 5, the depth of one groove (37*a*) of each pair of cooperating grooves 37*a*, 37*b* increases from its inner (left as viewed in FIG. 5) end toward its outer (right) end, and the depth of the other groove (37*b*) of each pair decreases from its inner end toward its outer end. This design enables the gripper plates to move toward and away from one another as they glide on the sets of ball bearings between their stated open and closed positions. The gripper plates are connected by a pair of pins, each designated 39, one end of each pair being press-fitted in a hole through one gripper plate and the other end of the pin being slidable in a hole through the other gripper plate (see FIG. 6). The gripper plates 31*a*, 31*b* are biased toward their open position by a pair of coil springs 41.

Indicated generally at 43 is means for rotating the drum 15 on axis AX1. Means 43 includes a one-way clutch, generally designated 45, mounted on the shank of bolt 19 between the drum 15 and the post 17. As will appear, this clutch is designed for transmitting torque to the drum 15 to rotate it in one direction but not the opposite direction.

As illustrated best in FIG. 3, the clutch has a cylindric body 47 having an outside diameter approximately the same as that of the drum, and a circular hub 49 at one end of the body received in a circular opening or recess 51 in the inside (right as viewed in FIG. 3) face of the drum. The body 47 and hub 49 of the clutch have a central axial bore 53 therethrough for receiving the shank of bolt 19. The inner (right as viewed in FIG. 3) face of the clutch body is recessed for receiving a suitable bearing 55. A circular washer 57 between this bearing and the post 17 is provided for spacing the clutch body from the post to avoid interference.

Again referring to FIG. 3, it will be observed that the outside diameter of the hub 49 of the clutch is somewhat less than the diameter of the recess 51 in the drum 15 thereby forming an annular gap 58 between the hub and the drum. Disposed within this gap is a coil spring 59 wrapped on the hub 49, the radial dimension of the gap being somewhat greater than the diameter of the spring wire to ensure that there is no contact between the spring and the drum 15. As indicated at 61, one end of the spring is bent for reception in a hole 63 in the drum to establish a connection between the spring and the drum. The arrangement is such that the spring 59 is adapted to tighten on the clutch hub 49 when the clutch is rotated in one direction (counterclockwise as viewed from the right side of FIG. 3) thereby to transmit torque (via the aforesaid connection between spring 59 and drum 15) to the drum for rotating it in that same direction, and to loosen on the clutch hub when the clutch is rotated in the opposite direction to permit relative rotation between the clutch and the drum. The importance of this feature will become apparent hereinafter.

Rotating means 43 also includes a lever 65 constituted by a length of metal rod threaded at one end into the body 49 of clutch 45 and projecting generally radially outwardly therefrom. This lever (referred to in the trade as a "weight arm") is designed to carry one or more cylindric masses which together constitute a tensioning weight 67 which is slidably adjustable along the lever to a position which is determined by the desired tension to be applied to string S. The tensioning weight is securable in adjusted position by thumbscrews 69.

The steps involved in using tensioning apparatus 13 to apply the desired tension to string S are sequentially illustrated in FIGS. 7A–7D. Thus, with the head of racket R appropriately clamped in vise 7, and the tensioning weight 67 secured in the appropriate position (depending on the desired string tension), the drum 15 and clutch 45 are rotated to the position shown in FIG. 7A wherein the lever or weight arm 65 is generally upright and the drum arm 25 extends generally horizontally away from the racket. The reach of string S to be tensioned is then placed between the gripper plates 31*a*, 31*b* (which are spring-biased toward their open position) and the plates pushed inwardly (to the left as viewed in FIG. 7A) with respect to the drum arm 25 to their closed position to grip the string and to hold it in a position in which it extends generally horizontally from the racket.

To tension the string S, the weight arm 65 is allowed to swing down under its own weight and that of the tensioning weight 67. This causes the clutch 45 to rotate in the same direction (clockwise as viewed in FIG. 7A) which tightens the coil spring 59 on the hub 49 of the clutch thereby to transmit torque to the drum 15 for rotating it in the same direction. As the drum rotates, the gripper plates 31*a*, 31*b* holding string S also rotate to pull the string to tension it.

To ensure that the desired string tension is achieved the weight arm 65 should come to rest in a generally horizontal position. If the lever does not reach horizontal, then the process must be restarted with the weight arm in a two o'clock position, for example, rather than the twelve o'clock position shown in FIG. 7A. The above process is then repeated (i.e., the string gripped and the weight arm allowed to swing down). If the lever comes to rest in a horizontal position, indicating that the string is at the predetermined tension, the string is suitably clamped at the racket and the gripper plates 31*a*, 31*b* then released whereupon they are urged by springs 41 to their open position to release the string S. The process is then repeated on the next reach of string to tension it.

Figure 7D:
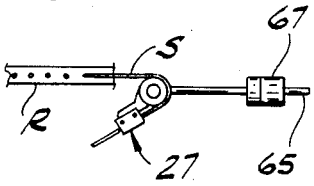
FIG. 7 is a schematic representation illustrating the operation of the tensioning apparatus.
Figure 7A:
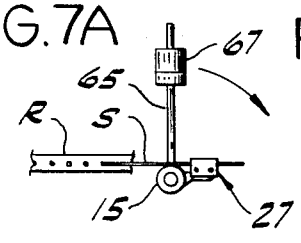
Figure 7B:
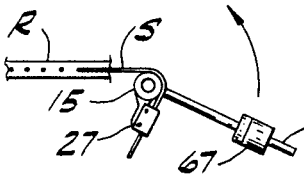
Figure 7C:
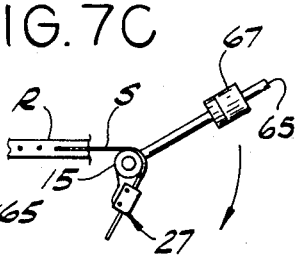

If, on the other hand, the weight arm 65 comes to rest in a position below horizontal, as shown in FIG. 7B, this indicates that the string is at less than the predetermined tension. In this situation, the one-way clutch 45 is particularly effective inasmuch as the string does not have to be clamped at the racket and the above process repeated. Instead, the weight arm 65 is simply swung back up while holding the drum 15 stationary against rotation. This causes the clutch 45 to rotate in the counterclockwise direction as shown in FIG. 7C. During this motion, the coil spring 59 loosens on the hub 49 of the clutch to permit the clutch to rotate or slip relative to the drum 15. When the weight arm 65 has been moved to an appropriate position above horizontal (FIG. 7C), it is released to swing down whereupon the coil spring on the clutch hub tightens to transmit torque to drum 15 to rotate it and the gripper mechanism and thereby further tension the string. If on this try the weight arm comes to rest in a horizontal position (FIG. 7D), the string S is at the desired tension. If not, and the weight arm again drops below horizontal, the above process can quickly and easily be repeated until the weight arm does finally assume a horizontal position to ensure accurate tension. Once an accurate tension has been achieved, the string is clamped at the racket and the next reach tensioned in the same manner.

It will be observed, therefore, that the stringing machine 1 described above and its unique tensioning apparatus 13 permits a string S to be accurately tensioned in a quick and easy manner. Moreover, unlike prior art stringing machines, each reach of string need not be clamped at the racket more than one time during the stringing process, which minimizes the risk of damage to the string.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In a racket-stringing machine of the type comprising a base, means on the base for holding the head of a racket in a generally horizontal plane and in fixed position with respect to the base, and tensioning apparatus adjacent said holding means for pulling a string on the racket to a predetermined tension, said tensioning apparatus being characterised in comprising:

a generally cylindric member mounted on the base adjacent said holding means for rotation on a generally horizontal axis;

means on the cylindric member for gripping said string; and means for rotating the cylindric member on said axis when said gripping means is gripping the string thereby to pull the string to said predetermined tension;

said rotating means comprising a one-way clutch means adapted for rotating the cylindric member on said axis in one direction but not the opposite direction, a lever on the clutch means extending generally radially with respect to said axis, and a tensioning weight positionable on the lever for causing the lever to swing downwardly to rotate the clutch means and the cylindric member in said one direction to a position in which the lever is either generally horizontal, indicating that the string is at said predetermined tension, or below horizontal, indicating that the string is at less than said predetermined tension, whereupon the lever is adapted to be swung upwardly to rotate the clutch means in said opposite direction, with the cylindric member being held stationary as the clutch means is so rotated, to a position sufficiently above horizontal that when the lever is released the tensioning weight will cause the lever to swing downwardly to rotate the clutch means and the cylindric member in said one direction to a position in which the lever is generally horizontal indicating that the string is at said predetermined tension.

2. In a racket-stringing machine as set forth in claim 1, said clutch means comprising a clutch body and a coil spring wrapped on the clutch body having a connection with said cylindric member, said spring being adapted to tighten on the clutch body when the clutch means is rotated in said one direction thereby to trasmit torque via said connection to the cylindric member for rotating it in said one direction, and being adapted to loosen on the clutch body when the clutch means is rotated in said opposite direction to permit relative rotation between the clutch means and the cylindric member.

3. In a racket-stringing machine as set forth in claim 2, said clutch body having a circular hub received in a circular opening in the cylindric member, said spring being wrapped on the hub and having one of its ends bent for reception in a hole in the cylindric member for making said connection.

4. In a racket-stringing machine as set forth in claim 1, said cylindric member having an arm extending laterally outwardly therefrom, said gripping means comprising a pair of grippers, and means mounting the grippers for linear movement in a direction generally parallel to the arm from an open position in which the grippers are spaced apart a distance greater than the diameter of said string to enable the string to be inserted between the grippers, to a closed position in which the grippers are spaced closer together for gripping the string therebetween, and back to said open position for releasing the string.

5. In a racket-stringing machine as set forth in claim 4, said gripper mounting means comprising a pair of generally parallel spaced apart mounting plates secured to said arm, said grippers comprising a second pair of generally parallel plates disposed between said mounting plates and in face-to-face relation therewith.

6. In a racket-stringing machine as set forth in claim 5, said gripper plates being movable inwardly with respect to the arm from said open position to said closed position, and outwardly with respect to the arm from said closed position to said open position.

7. In a racket-stringing machine as set forth in claim 6, said gripper plates being spring-biased toward said open position.

8. Tensioning apparatus for a racket-stringing machine of the type comprising a base and means on the base for holding the head of a racket in a generally horizontal plane and in fixed position with respect to the base, said tensioning apparatus comprising:

a generally cylindric member adapted to be mounted on the base adjacent said holding means for rotation on a generally horizontal axis;

means on the cylindric member for gripping said string;

means for rotating the cylindric member on said axis when said gripping means is gripping the string thereby to pull the string to a predetermined tension;

said rotating means comprising a one way clutch means adapted for rotating the cylindric member on said axis in one direction but not the opposite direction, said clutch means being adapted for the attachment thereto of a lever having a tensioning weight thereon, said weight being adapted for causing the lever to swing downwardly to rotate the clutch means and the cylindric member in said one direction to a position in which the lever is either generally horizontal, indicating that the string is at said predetermined tension, or below horizontal, indicating that the string is at less than said predetermined tension, whereupon the lever is adapted to be swung upwardly to rotate the clutch means in said opposite direction, with the cylindric member being held stationary as the clutch means is so rotated, to a position sufficiently above horizontal that when the lever is released the tensioning weight will cause the lever to swing downwardly to rotate the clutch means and the cylindric member in said one direction to a position in which the lever is generally horizontal indicating that the string is at said predetermined tension.

9. Tensioning apparatus as set forth in claim 8 wherein said clutch means comprises a clutch body and a coil spring wrapped on the clutch body having a connection with said cylindric member, said spring being adapted to tighten on the clutch body when the clutch means is rotated in said one direction thereby to transmit torque via said connection to the cylindric member for rotating it in said one direction, and being adapted to loosen on the clutch body when the clutch means is rotated in said opposite direction to permit relative rotation between the clutch means and the cylindric member.

10. Tensioning apparatus as set forth in claim 9 wherein said clutch body has a circular hub received in a circular opening in the cylindric member, said spring being wrapped on the hub and having one of its ends bent for reception in a hole in the cylindric member for making said connection.

11. Tensioning apparatus as set forth in claim 8 wherein said cylindric member has an arm extending laterally outwardly therefrom, said gripping means comprising a pair of grippers, and means mounting the grippers for linear movement with respect to the arm from an open position in which the grippers are spaced apart a distance greater than the diameter of said string to enable the string to be inserted between the grippers, to a closed position in which the grippers are spaced closer together for gripping the string therebetween, and back to said open position for releasing the string.

12. Tensioning apparatus as set forth in claim 11 wherein said gripper mounting means comprises a pair of generally parallel spaced apart mounting plates secured to said arm, said grippers comprising a second pair of generally parallel plates disposed between said mounting plates and in face-to-face relation therewith.

13. Tensioning apparatus as set forth in claim 12 wherein said gripper plates are movable inwardly with respect to the arm from said open position to said closed position, and outwardly with respect to the arm from said closed position to said open position.

14. Tensioning apparatus as set forth in claim 13 wherein said gripper plates are spring-biased toward said open position.

* * * * *